US012497850B2

(12) United States Patent
Machocki

(10) Patent No.: US 12,497,850 B2
(45) Date of Patent: Dec. 16, 2025

(54) CASING EROSION TOOL WITH PIVOTABLE JETTING SUB

(71) Applicant: ARAMCO OVERSEAS COMPANY UK LTD, Westhill (GB)

(72) Inventor: Krzysztof Machocki, Westhill (GB)

(73) Assignee: ARAMCO OVERSEAS COMPANY UK LTD, Westhill (GB)

( * ) Notice: Subject to any disclaimer, the term of this patent is extended or adjusted under 35 U.S.C. 154(b) by 0 days.

(21) Appl. No.: 18/671,683

(22) Filed: May 22, 2024

(65) Prior Publication Data

US 2025/0361782 A1 Nov. 27, 2025

(51) Int. Cl.
*E21B 29/00* (2006.01)

(52) U.S. Cl.
CPC ..... *E21B 29/002* (2013.01)

(58) Field of Classification Search
CPC ..... E21B 10/32; E21B 10/61; E21B 29/002
See application file for complete search history.

(56) References Cited

U.S. PATENT DOCUMENTS

| | | | | |
|---|---|---|---|---|
| 5,381,631 | A * | 1/1995 | Raghavan | B24C 5/04 451/36 |
| 10,954,744 | B2 | 3/2021 | Skeels et al. | |
| 11,002,097 | B2 | 5/2021 | Rairigh | |
| 11,585,176 | B2 * | 2/2023 | Hitchcock | E21B 28/00 |
| 2006/0231258 | A1 * | 10/2006 | Head | E21B 29/06 166/384 |
| 2007/0251692 | A1 | 11/2007 | Billingham | |
| 2013/0284440 | A1 * | 10/2013 | McAfee | E21B 43/114 166/298 |
| 2014/0352964 | A1 * | 12/2014 | Surjaatmadja | E21B 29/06 73/865.9 |
| 2016/0115755 | A1 | 4/2016 | Mcafee et al. | |

FOREIGN PATENT DOCUMENTS

| | | | |
|---|---|---|---|
| CN | 116084882 | A | 5/2023 |
| WO | 2022081017 | A1 | 4/2022 |
| WO | 2022240295 | A1 | 11/2022 |

OTHER PUBLICATIONS

PCT International Search Report & Written Opinion pertaining to International Application No. PCT/US2025/027370; Date of Mailing: Jul. 24, 2025.

* cited by examiner

*Primary Examiner* — James G Sayre
(74) *Attorney, Agent, or Firm* — Vorys, Sater, Seymour and Pease LLP

(57) ABSTRACT

A tool string for progressive milling of concentric casing strings and cement columns in a wellbore includes an anchoring tool mateable to a downhole end of a tubing and operable engage the at least one of the concentric casing strings and cement columns to lock a position of the anchoring tool within the wellbore, a jetting head arranged at a downhole end of the tool string and including one or more nozzles for discharging an abrasive fluid from the jetting head towards one or more of the concentric casing strings and/or cement columns of the wellbore, and a running and control tool interposing the anchoring tool and jetting head. The running and control tool is operable to adjust an orientation of the jetting head with respect to the anchoring tool within the wellbore.

17 Claims, 6 Drawing Sheets

CASING EROSION TOOL WITH PIVOTABLE JETTING SUB

FIELD OF THE DISCLOSURE

The present disclosure relates generally to selectively eroding concentric casing strings and interposing cement columns in a wellbore and, more particularly, to methods and systems for precise casing and cement erosion using abrasive fluids.

BACKGROUND OF THE DISCLOSURE

Oil and gas wellbores are commonly drilled in a series of progressively smaller casings until reaching a desired depth. A wellbore drilling operation may begin with drilling into a formation to a specified depth for a first casing string, also known as a first "casing depth". The first casing string may be run downhole to the first casing depth and cemented in place by pumping cement between the formation and the first casing string to form a first stage cement column. The operation may continue with drilling to a second casing depth and running a second casing string downhole through the first casing string. The second casing string may then be cemented in place with a second stage cement column formed by pumping cement upward between the second casing string and the formation and continuing upward through a "casing-casing annulus" defined between the first casing string and the second casing string. The operation may continue with subsequent drilling and cementing stages until reaching a desired wellbore depth.

Once the drilling is complete, production tubing may be extended into the wellbore and through the innermost casing string, and production operations may be initiated to recover oil and gas resources through the production tubing. During production operations, cracks or imperfections within the cement columns may lead to leaks or failures within the cement columns. These leaks may lead to a sustained casing pressure behind one or more casing strings, which may lead to undesirable flow within one or more casing-casing annuli and negatively affect overall wellbore integrity.

To avoid costly workover operations on wellbores with sustained casing pressure, methods have been developed to correct leaks or failures downhole. These methods include deploying a perforation gun or other tool to form perforations through the casing strings and cement columns, and then inserting (injecting) a resin mixture within the perforated area to seal the leaks. Since the perforation gun may utilize explosives and other hazardous equipment, forming the perforations may result in damage to the surrounding area and weakening of the geology surrounding the wellbore. Further, other repair methods may necessitate tripping one or more casing strings out of the wellbore to perform corrective actions, particularly in smaller diameter wellbores and repairs needing precise interventions.

Accordingly, methods and systems are desired for precision access to annuli within concentric casings without pulling the casings out of the wellbore.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a tool string for progressive milling of concentric casing strings and cement columns in a wellbore includes an anchoring tool mateable to a downhole end of a tubing and operable to engage the at least one of the concentric casing strings and cement columns to lock a position of the anchoring tool within the wellbore, a jetting head arranged at a downhole end of the tool string and including one or more nozzles for discharging an abrasive fluid from the jetting head towards one or more of the concentric casing strings and/or cement columns of the wellbore, and a running and control tool interposing the anchoring tool and jetting head, the running and control tool operable to adjust an orientation of the jetting head with respect to the anchoring tool within the wellbore.

In another embodiment, a method of progressively milling one or more concentric casing strings and cement columns within a wellbore includes disposing a tool string within the wellbore and advancing the tool string to a milling location, pumping an abrasive fluid from a surface location to the tool string, and discharging the abrasive fluid from one or more nozzles of a jetting head disposed at a downhole end of the tool string to erode a portion of a first one of the concentric casing strings and/or cement columns. The method further includes re-orienting the jetting head with respect to a running and control tool of the tool string to aim the nozzles towards a portion of a further one of the concentric casing strings and/or cement columns.

In a further embodiment, a wellbore system exhibiting a sustained casing pressure includes a plurality of concentric casing strings disposed within a wellbore, a plurality of cement columns each disposed radially outward of a respective one of the concentric casing strings, and a tool string disposed within a radially innermost one of the concentric casing strings. The tool string includes a jetting head including a plurality of nozzles through which an abrasive fluid may be discharged at a sufficient pressure to erode the concentric casing strings, the cement columns, or a combination thereof, and a running and control tool mated to the jetting head at an interface and including a pivoting mechanism operable to pivot the jetting head at one or more angles towards the concentric casing strings, the cement columns, or a combination thereof.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
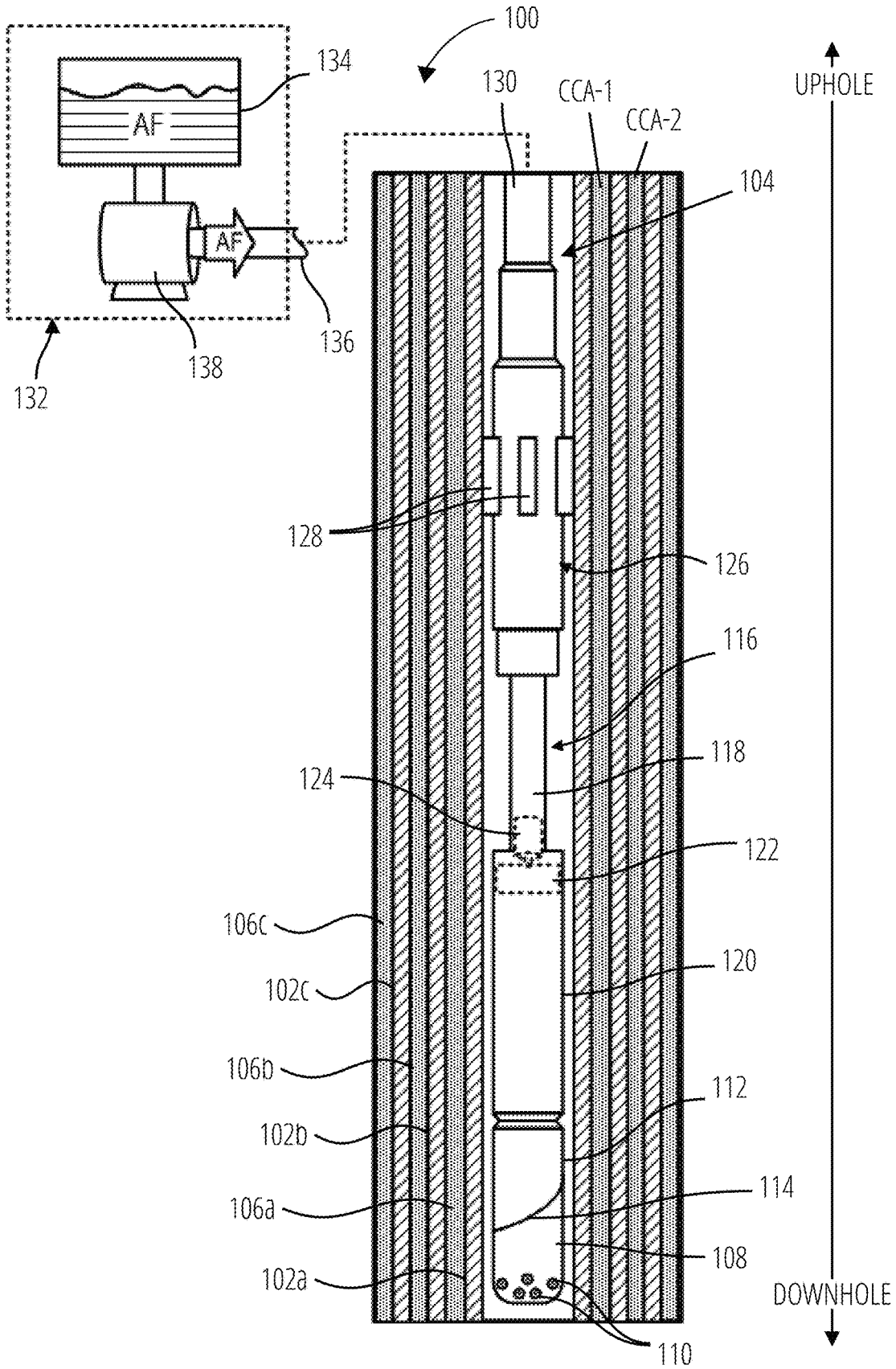
FIG. 1 is a schematic cross-sectional side view of a wellbore with a plurality of concentric casing strings and interposing cement columns installed therein, and a tool string inserted through the casing strings, according to one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to selective erosion of concentric casing strings and interposing cement columns and, more particularly, to methods and systems for precise milling of the casing strings and cement milling via erosion with abrasive fluids. Embodiments disclosed herein include a tool string operable for abrasive fluid milling of one or more concentric casing strings and/or cement columns by discharging an abrasive fluid through a jetting head carried by the tool string, as well as methods of use. The jetting head of the disclosed embodiments may be selectively oriented (orientable) within a wellbore to adjust an angle (orientation) or a clearance (position) of the jetting head to enable milling of multiple milling surfaces without tripping out of the wellbore. In some embodiments, a running and control tool in the tool string may include a pivoting mechanism to adjust the angle of the jetting head relative to the running and control tool to aim and orient nozzles of the jetting head with respect to the walls of the wellbore. The pivoting mechanism may enable pivoting of the jetting head from parallel to perpendicular with respect to the running and control tool, such that a length of the jetting head may define a maximum lateral extension of the jetting head from the running and control tool. The running and control tool may further include a controller therein, including a processor and memory for autonomous or remote control of the jetting head within the wellbore. The disclosed embodiments may further include anchoring tools, stroking tools, and tubings as components of the tool string to enable travel, rotation, and stabilization of the jetting head and other components within the wellbore.

FIG. 1 is a schematic cross-sectional side view of an example wellbore 100 having concentric casing strings 102*a*, 102*b*, and 102*c* installed therein, and a tool string 104 inserted within the casing strings 102*a-c*. The concentric casing strings 102*a-c* may be interposed with and/or surrounded by corresponding cement columns 106*a*, 106*b*, 106*c*. The cement columns 106*a-c* may retain the concentric casing strings 102*a-c* within the wellbore 100, and may further prevent the flow of fluids through casing-casing annuli (CCA-1 and CCA-2) defined between the concentric casing strings 102*a-c*.

In some applications, however, the cement columns 106*a-c* may develop one or more microfractures or channels that enable fluid flow within the casing-casing annuli CCA-1 and CCA-2. Fluid flow within the casing-casing annuli may generate a sustained casing pressure behind one or more of the concentric casing strings 102*a-c*, and such sustained casing pressure may result in well stability problems, environmental concerns, and underground blowouts if unaddressed. Repair efforts in the casing-casing annuli CCA-1 and CCA-2 may be difficult, however. Access to the casing-casing annuli CCA-1 and CCA-2 may be unavailable from within the wellbore 100 as the concentric casing strings 102*a-c* and cement columns 106*a-c* may obstruct a repair location.

According to embodiments of the present disclosure, the tool string 104 may be conveyed into the interior of the first concentric casing string 102*a* to help perform a repair. More specifically, the tool string 104 may include a jetting head 108 disposed at a bottom (downhole) end thereof, such that the tool string 104 may terminate at the jetting head 108. The jetting head 108 may include a plurality of nozzles 110 arranged about the jetting head 108 and configured to discharge an abrasive fluid "AF" at various angles and in various directions.

The jetting head 108 may be pivotably coupled to a running and control tool 112 at an interface 114. Opposing edges of the jetting head 108 and the running and control tool 112 may abut and slidingly engage at the interface 114 such that the running and control tool 112 may be operable to manipulate an orientation of the jetting head 108 via edge interactions at the interface 114. In some embodiments, the running and control tool 112 may actively control and steer the jetting head 108 during milling (jetting) operations. In these operations, the running and control tool 112 may be pre-programmed to rotate and pivot the jetting head 108 to selectively remove portions of the concentric casing strings 102*a-c* and cement columns 106*a-c*. Additionally or alternatively, the running and control tool 112 may be in communication with a controller (not shown) at an external location for receiving real-time commands from an operator.

The tool string 104 may further include a stroking tool 116 coupled to the running and control tool 112 at an upper (uphole) end thereof. The stroking tool 116 is generally operable to provide (facilitate) axial displacement of the jetting head 116 and any other components of the tool string 104 coupled downhole of the stroking tool 116. The stroking tool 116 may include a stroking piston 118 at an uphole end thereof, and may further include an extendable sleeve 120 selectively translatable over the stroking piston 118. The extendable sleeve 120 may be retained on the stroking piston 118 via a stroking piston head 122 mated to, or integrally formed with, the stroking piston 118. The extendable sleeve 120 may be pressurized above or below the stroking piston head 122 to respectively translate the extendable sleeve 120 upwardly or downwardly (longitudinally) over the stroking piston head 122. The extendable sleeve 120 may be coupled the running and control tool 112 and jetting head 108 such that the translation of the extendable sleeve 120 extends (e.g., downhole movement) and/or retracts (e.g., uphole movement) the running and control tool 112 and jetting head 108 relative to the remainder of the tool string 104 above the stroking tool. Translation of the extendable sleeve 120 may be hydraulically driven by a pressure differential across the stroking piston head 122 as described above, and/or may be electronically controlled via one or more motors (not shown) operably coupled to the extendable sleeve 120.

In some embodiments, the stroking piston head 122 may be rotationally coupled to the extendable sleeve 120, such that the extendable sleeve 120 may be rotated with respect to the stroking piston head 122 to drive rotation of the running and control tool 112 and the jetting head 108. In these embodiments, the stroking tool 116 may include a rotational driver 124, such as a motor, coupled to the stroking piston head 122 and operably engaged with the extendable sleeve 120. The rotational driver 124 may provide a torque to the extendable sleeve 120 to effect rotation as desired.

In some embodiments, the stroking piston 118 and the extendable sleeve 120 may include complementary threads thereon, such that a screw action may provide both rotation and extension of the running and control tool 112 and the jetting head 108 simultaneously. In further embodiments, however, rotation of the running and control tool 112 and jetting head 108 may be driven and controlled in alternate locations and/or by other components.

The tool string 104 may further include an anchoring tool 126 mated to an uphole end of the stroking tool 116 and otherwise located uphole from the stroking tool 116. The anchoring tool 126 may include one or more anchoring pads 128, which may be radially extended to engage the inner wall of the first concentric casing string 102*a*, and thereby secure the anchoring tool 126 in position within the wellbore 100. In some embodiments, the anchoring pads 128 may be hydraulically actuated with a hydraulic fluid providing pressure within the anchoring tool 126. In further embodiments, the anchoring pads 128 may be electrically driven by one or more motors (not shown) within the anchoring tool 126 to radially extend the anchoring pads 128 therefrom and/or to radially retract the anchoring pads 128. The anchoring pads 128 may be deformable, such that the anchoring pads 128 may be compressed against the first concentric casing string 102*a* to generate an interference fit therewith and thereby retain the anchoring tool 126 in place and limit motion of the tool string 104. In some embodiments, the anchoring pads 128 may be formed of a high-toughness steel with a hardness in the range of about 60 Hardness Rockwell scale B (HRB) to about 85 Rockwell HRB.

The tool string 104 may be run into the wellbore 100 at an end of a tubing 130, which may be operatively coupled to an uphole end of the anchoring tool 126. The tubing 130 may comprise a variety of types of downhole conveyances including, but not limited to, coiled tubing, drill pipe, or e-coil, such that a flowpath may be provided for both fluids and signals (electrical command signals, data, etc.) to be transmitted therethrough from a surface location 132.

The surface location 132 may include a fluid reservoir 134 storing and providing a volume of abrasive fluid "AF" to be conveyed to the tool string 104. The fluid reservoir 134 may be in fluid communication with the tool string 104, and more specifically the tubing 130, via a fluid line 136 extending from the surface location 132 to the wellbore 100. In some embodiments, the surface location 132 may further include a fluid pump 138 interposing the fluid line 136 and the fluid reservoir 134. The fluid pump 138 may be operable to pressurize or pump the abrasive fluid "AF" to the jetting head 108. At the jetting head 108, the abrasive fluid "AF" will be discharged at a rate sufficient to erode the casing strings 102*a-c* and interposing cement columns 106*a-c*.

As a non-limiting example, the abrasive fluid "AF" may contain an abrasive agent, such as sand, alumina/aluminum oxide, garnet, silicon carbide, or glass beads suspended therein to provide abrasive characteristics to a carrier fluid. In some embodiments, multiple fluid pumps 138 may be disposed at the surface location 132 to provide variable pumping rates corresponding to the surface to be eroded via the jetting head 108.

Figure 2:
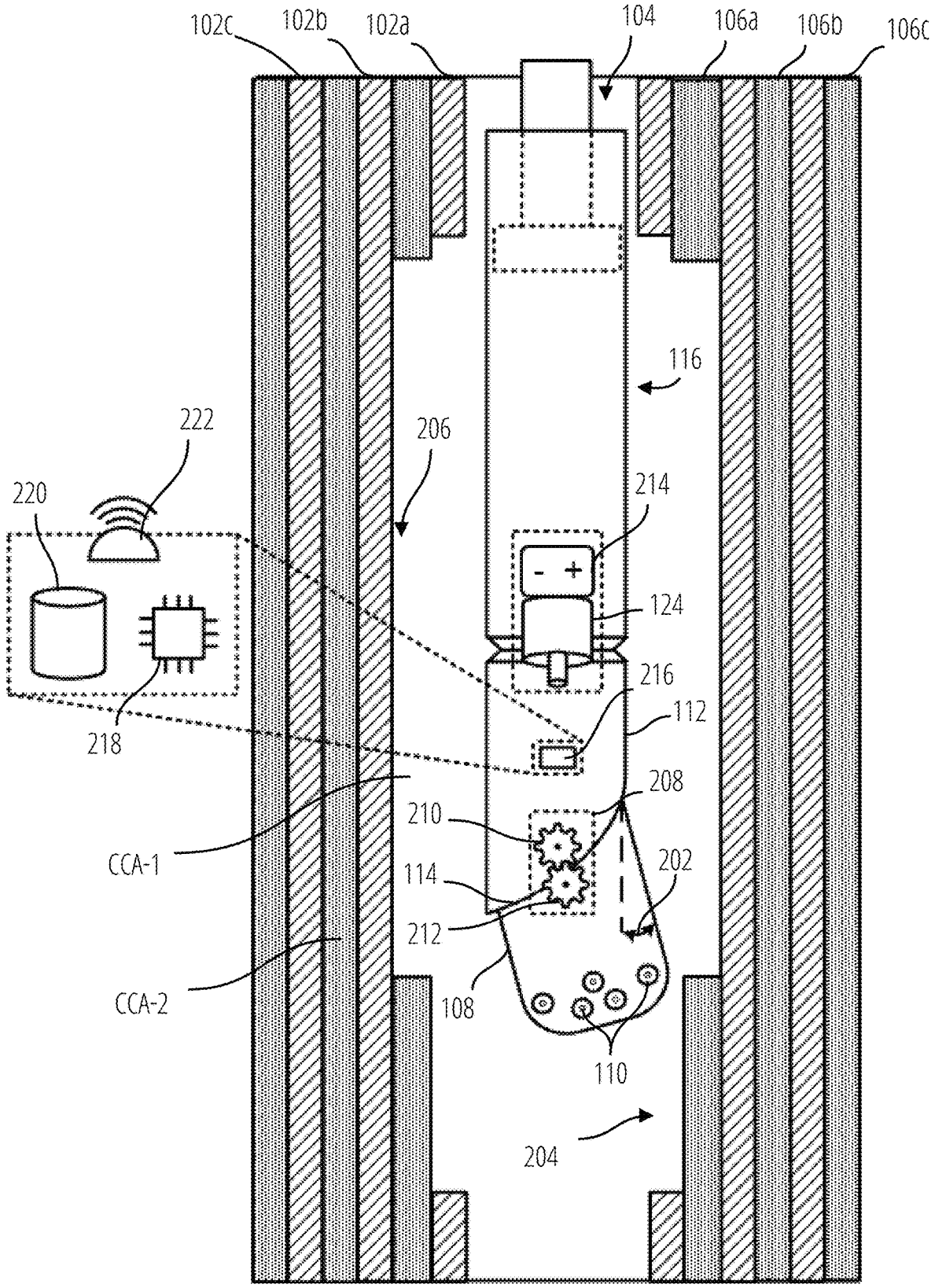
FIGS. 2-4 illustrate progressive operation of an abrasive jetting tool carried by the tool string during a milling operation in which the concentric casing strings and interposing cement columns are selectively eroded, according to at least one embodiment of the present disclosure.
Figure 3:
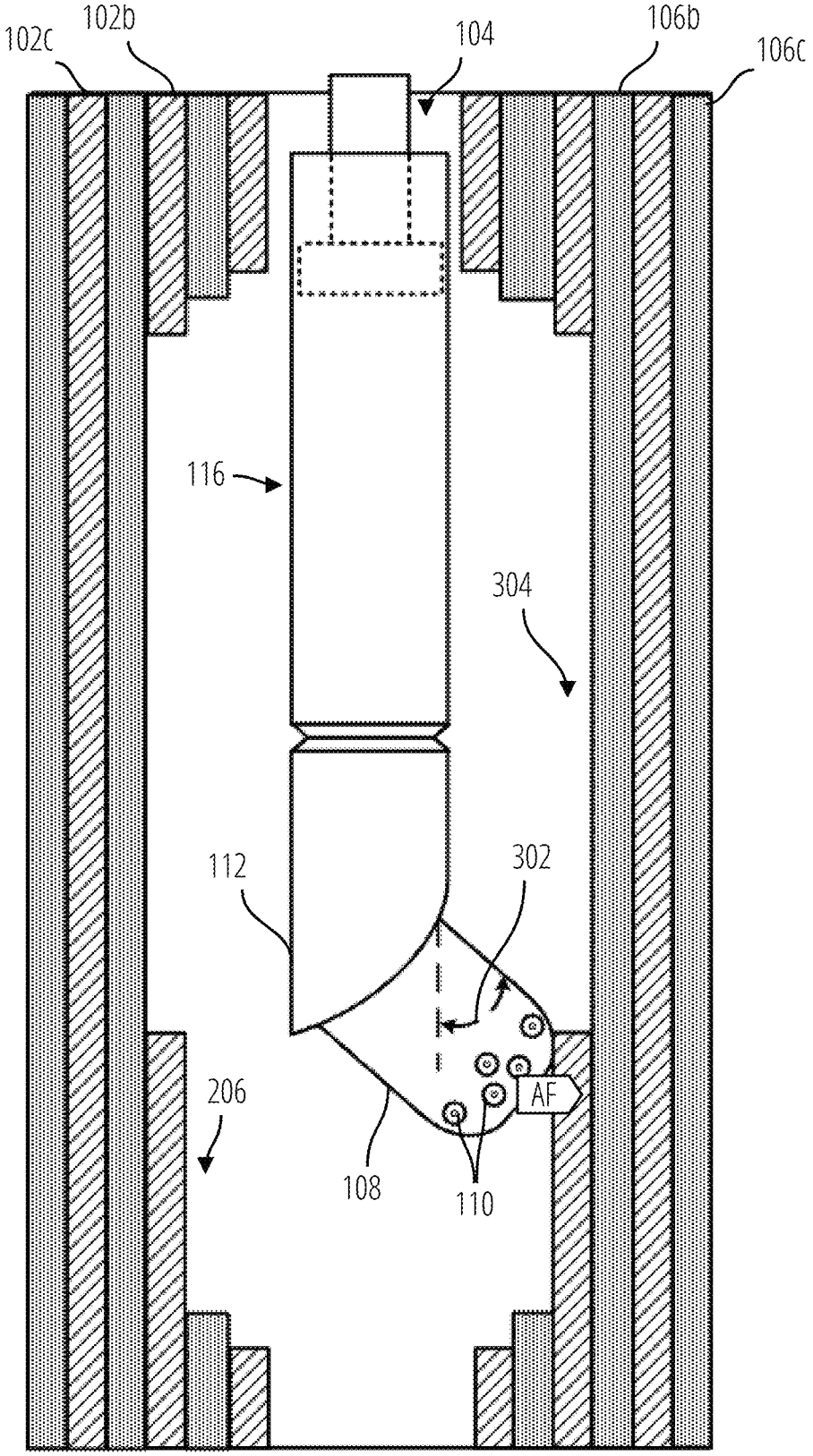
Figure 4:
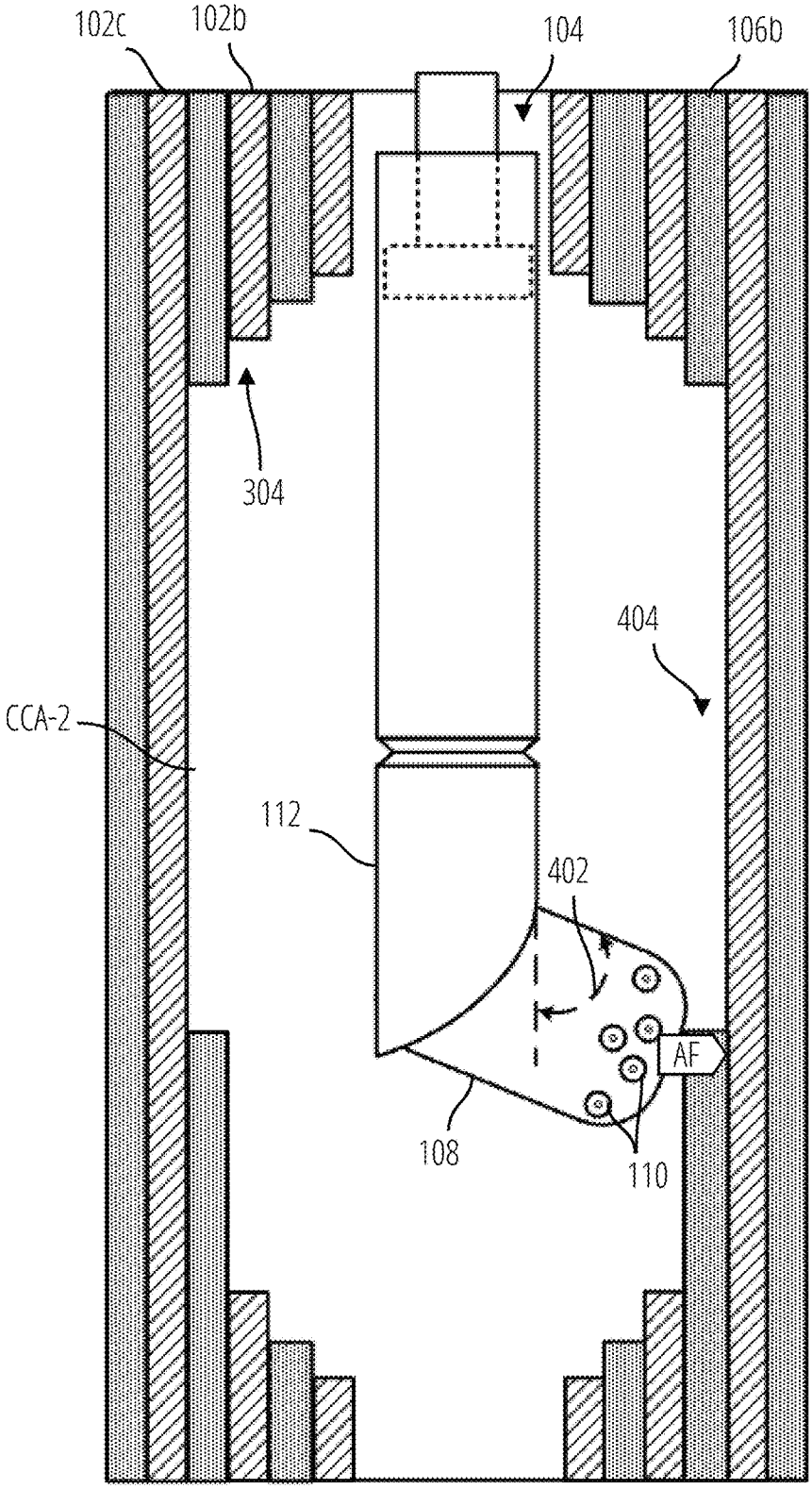

FIGS. 2-4 illustrate progressive operation of the tool string 104 during an example milling operation in which the concentric casing strings 102*a-c* and interposing cement columns 106*a-c* are selectively and progressively eroded, according to at least one embodiment of the present disclosure.

FIG. 2 is a schematic side view of a downhole end of the tool string 104 following selective erosion of portions of the first concentric casing string 102*a* and first cement column 106*a*. As seen in the illustrated embodiment, the jetting head 108 is pivoted away from the running and control tool 112 at a first angle 202. Orienting the jetting head 108 to the first angle 202 allows the nozzles 110 to be aimed towards specific portions of the concentric casing strings 102*a-c* and cement columns 106*a-c* to be eroded.

Pivoting the jetting head 108 to the first angle 202 enables the creation of a first casing window 204 and first cement window 206 by eroding portions of the first concentric casing string 102*a* and the first cement column 106*a*, respectively. In some embodiments, the first cement window 206 may be generated at a smaller length than that of the first casing window 204 to create a stepped pattern between the first cement window 206 and first casing window 204. In further embodiments, however, the first casing window 204 and first cement window 206 may be of equal size. In some embodiments, milling of the concentric casing strings 102*a-c* and interposing cement columns 106*a-c* may cease at this point, as the first casing-casing annulus CCA-1 is exposed for repair operations. However, in further embodiments, milling operations may continue until reaching and exposing the second casing-casing annulus CCA-2.

In the illustrated embodiment, an example pivoting mechanism 208 is shown at the interface 114. The pivoting mechanism 208 may include a stationary gear 210 coupled to the running and control tool 112 and a traveling (rotating) gear 212 coupled to the jetting head 108. The stationary gear 210 may be operably engaged with the traveling gear 212 such that relative motion between the gears 210, 212 causes the jetting head 108 to move relative to the running and control tool 112, for example until reaching the first angle 202. It should be noted, however, that other pivoting mechanisms 208 may be contemplated and included here without departing from the scope of this disclosure. As a non-limiting example, FIG. 5 may include an alternate embodiment of a jetting head (jetting head 500) with a varying actuation mechanism.

FIG. 2 further depicts an additional or alternate location for the rotational driver 124, such that the rotational driver 124 is included between the stroking tool 116 and the running and control tool 112 to directly drive the running and control tool 112 with respect to the extendable sleeve 120 (FIG. 1). In further embodiments, the rotational driver 124 may be positioned between the anchoring tool 126 of FIG. 1 and the jetting head 108, just below the anchoring pads 128 of FIG. 1, or at a surface location (e.g., surface location 132 of FIG. 1) to help facilitate rotation to the entire tool string 104. Further, in the illustrated embodiment, a power source 214 is electrically coupled to the rotational driver 124 to enable actuation of the rotational driver 124 downhole. The power source 214 may include a battery mounted within the stroking tool 116, or may alternatively comprise an electrical wire coupled to the rotational driver 124 and an external power source (not shown).

As discussed above, the running and control tool 112 may be controlled via a controller 216, which may be installed within the running and control tool 112 or at an external location. As shown in the enlarged graphic, the controller 216 may include a processor 218 and a memory 220 for storage and performance of one or more commands or computer-readable instructions during operation. The controller 216 may further include an access point 222 operable to send and/or receive communications from an operator at a surface location (e.g., the surface location 132). The access point 222 may be a wireless access point, as shown, or may be a wired access point physically connected to a communication line disposed within the tubing 130 of FIG. 1. The memory 220 may store pre-loaded commands, or may receive commands in real-time via the access point 222 to be performed by the processor 218. The processor 218 may be in communication with any actuating means within the tool string 104 for control of the stroking tool 116, anchoring tool 126 of FIG. 1, running and control tool 112, and jetting head 108 during operation.

FIG. 3 is a schematic side view of a downhole end of the tool string 104 during selective erosion of portions of the second concentric casing string 102*b*. The progressive pivoting of the jetting head 108 may be seen in the illustrated embodiment, such that the jetting head 108 forms a second angle 302 with respect to the running and control tool 112. The second angle 302 may be greater than the first angle 202 (FIG. 2), and may further aim the nozzles 110 towards the further (radially outward) concentric casing strings 102*b-c* and further (radially outward) cement columns 106*b-c*.

The nozzles 110 may emit or discharge the abrasive fluid "AF" at a desired flowrate or pressure to erode the material (e.g., steel) of the second concentric casing string 102*b*. In some embodiments, the nozzles 110 may continuously discharge the abrasive fluid "AF" during pivoting and travel of the jetting head 108. In other embodiments, however, each nozzle 110 may be selectively activated and deactivated to precisely control the jetting operation. The jetting head 108 may be translated along the second concentric casing string 102*b* using the stroking tool 116, and may be rotated to mill (erode) away a full circumference of the second concentric casing string 102*b* via the rotational driver(s) 124 (FIGS. 1-2). The second concentric casing string 102*b* may be eroded to create a second casing window 304. In some embodiments, as illustrated, the second casing window 304 may exhibit a shorter length as compared to the length of the first cement window 206, which continues a stepped pattern of milling.

FIG. 4 is a schematic side view of a downhole end of the tool string 104 during selective erosion of portions of the second cement column 106*b*. The progressive pivoting of the jetting head 108 may be seen in the illustrated embodiment, such that the jetting head 108 forms a third angle 402 with respect to the running and control tool 112. The third angle 402 may be greater than the first angle 202 of FIG. 2 and the second angle 302 of FIG. 3, and may further aim the nozzles 110 towards the third concentric casing string 102*c* and third cement column 106*c*. The nozzles 110 may emit or discharge the abrasive fluid "AF" at a desired flowrate or pressure to erode away the cement of the second cement column 106*b*. The jetting head 108 may be translated along the second cement column 106*b* using the stroking tool 116, and may be rotated to erode away a full circumference of the second cement column 106*b* via the rotational driver 124 of FIGS. 1-2. The second cement column 106*b* may be milled to create a second cement window 404 at a shorter length than that of the second casing window 304 to continue a stepped pattern of milling.

Following completion of the second cement window 404, the milling operations of the tool string 104 may cease, as the casing-casing annulus CCA-2 is now exposed to the inside of the wellbore 100. Accordingly, the tool string 104 may be tripped out of the wellbore 100 (i.e., returned to the well surface) and a repair assembly (not shown) may be conveyed downhole to perform repair operations to correct sustained casing pressure. In further embodiments, however, the milling operations may continue until the jetting head 108 is perpendicular to the running and control tool 112, and the nozzles 110 face the surface to be milled.

Figure 5:
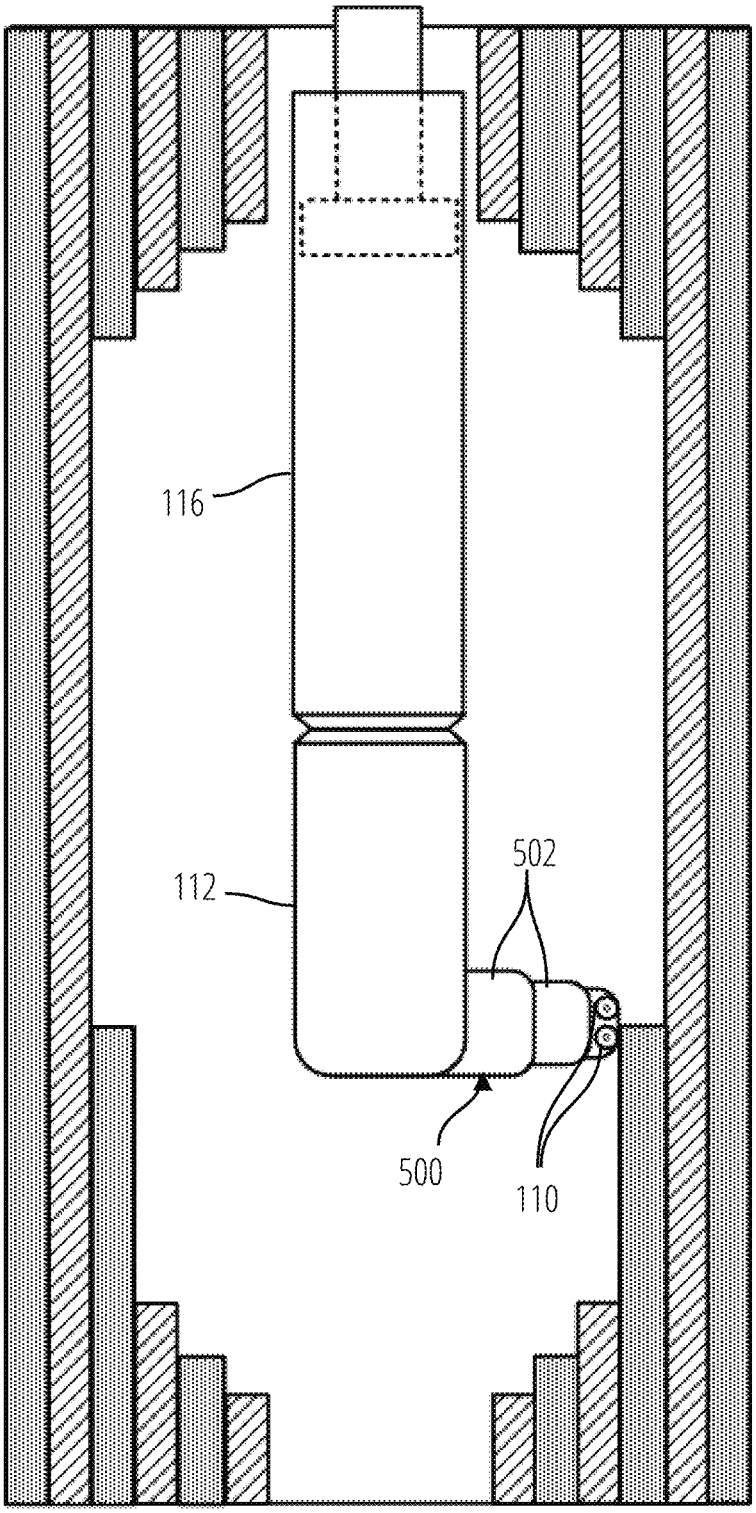
FIG. 5 is a schematic cross-sectional side view of a wellbore with partially-milled concentric casing strings and an alternate embodiment of an abrasive jetting tool inserted therein, according to one or more embodiments of the present disclosure.

FIG. 5 is a schematic cross-sectional side view of the wellbore 100 with partially-milled concentric casing strings 102*a-c* and an alternate embodiment of an abrasive jetting head 500 arranged therein, according to one or more embodiments of the present disclosure. The jetting head 500 may be mated or otherwise coupled to the running and control tool 112 in a perpendicular orientation, such that the jetting head 500 extends radially outward towards the concentric casing strings 102*a-c*. The jetting head 500 may include one or more telescoping members 502 nested within the jetting head 500, and operable to translate radially outward toward a surface to be milled. An innermost telescoping member 502 may include one or more nozzles 110 oriented towards the concentric casing strings 102*a-c*.

The telescoping members 502 may be retracted as the jetting head 500 is conveyed downhole. Upon reaching a desired location with the wellbore, however, the jetting head 500 may be actuated via hydraulic, pneumatic, or mechanical action to extend the telescoping members 502 at or near the surface to be milled. As each of the concentric casing strings 102*a-c* and cement columns 106*a-c* are milled (eroded), the telescoping members 502 may further extend to place the nozzles 110 at or near the surface of the particular casing string 102*a-c* and/or cement column 106*a-c* being milled. As with the jetting head 108 of FIGS. 1-4, the running and control tool 112 may control operations of the jetting head 500 and the uphole and downhole translation of the jetting head 500 may be performed via the stroking tool 116. As above, the rotation of the jetting head 500 may be provided by the running and control tool 112 and/or the stroking tool 116, depending upon the actuation mechanism employed.

Figure 6:
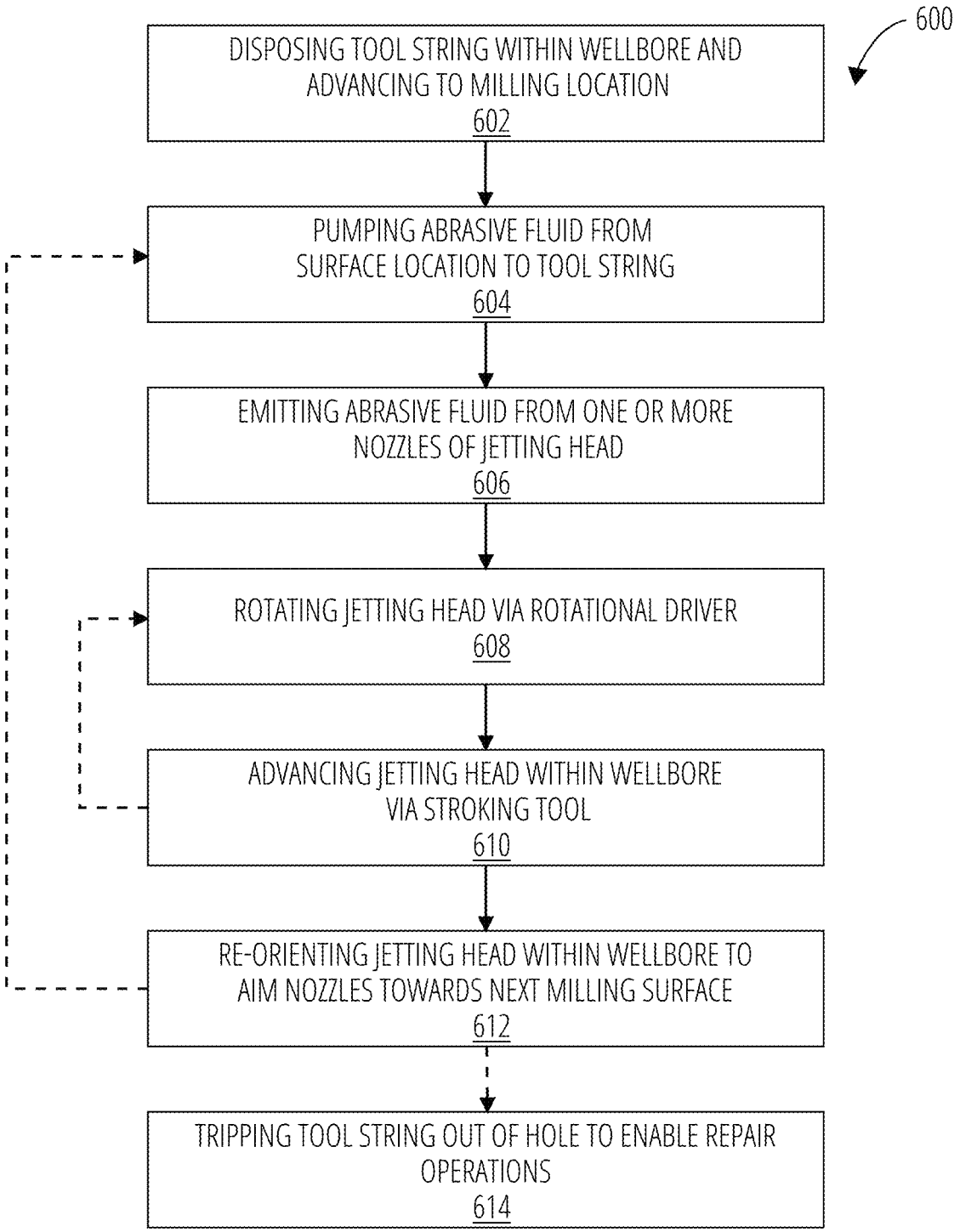
FIG. 6 is a schematic flowchart of an example method for accessing an annulus within concentric casing strings by selectively eroding the at least a portion of the casing strings and interposing cement columns with an abrasive jetting tool.

FIG. 6 is a schematic flowchart of an example method 600 for accessing an annulus within concentric casing strings via a tool string including a jetting head. Although the example method 600 depicts a particular sequence of operations, the sequence may be altered without departing from the scope of the present disclosure. For example, some of the operations depicted may be performed in parallel or in a different sequence that does not materially affect the function of the method 600. In other examples, different components of an example device or system that implements the method 600 may perform functions at substantially the same time or in a specific sequence.

According to some examples, the method 600 may begin at 602 with disposing (conveying) a tool string (e.g., the tool string 104) within a wellbore (e.g., the wellbore 100). In some embodiments, the tool string may be advanced to a milling location selected to remedy a sustained casing pressure identified in the wellbore. The tool string may include at least a jetting head (e.g., the jetting head 108 or jetting head 500), a running and control tool (e.g., the running and control tool 112), a stroking tool (e.g., the stroking tool 116), and a tubing (e.g., the tubing 130). In some embodiments, advancing the tool string within the wellbore may conclude with extending one or more anchoring pads (e.g., the anchoring pads 128) of the anchoring tool to lock portions of the tool string in place via an interference fit.

The method 600 may further include pumping an abrasive fluid (e.g., the abrasive fluid "AF") from a surface location (e.g., the surface location 132) to the tool string at 604. In some embodiments the surface location may include a fluid reservoir (e.g., the fluid reservoir 134) for sourcing the abrasive fluid. The fluid reservoir may include a fluid tank, an open hole, a tanker truck, or other high-capacity fluid reservoir. In some embodiments, the surface location 132 may further include a fluid pump (e.g., the fluid pump 138) to pressurize the abrasive fluid from the fluid reservoir and pump the abrasive fluid into a fluid line (e.g., the fluid line 136) in fluid communication with the tubing of the tool string. The abrasive fluid may be pumped at a sufficiently high pressure at 604 to enable the abrasive fluid to penetrate steel or cement when emitted or discharged through the jetting head.

The method 600 may further include emitting or discharging the abrasive fluid from one or more nozzles (e.g., the nozzles 110) of the jetting head at 606. In some embodiments, the jetting head may include an array of nozzles distributed about the jetting head to cover a plurality of angles and orientations if the jetting head is pivotably coupled to the running and control tool. In further embodiments, however, the jetting head may include one or more nozzles at an end of a plurality of telescoping members (e.g., the telescoping members 502). In these embodiments, the nozzles may be directly aimed towards the milling surface, and may be radially extendible to reduce a jetting distance between the nozzles and a targeted milling surface. In the disclosed embodiments, the milling surface may be any of the concentric casing string (e.g., the concentric casing strings 102*a-c*) or the cement columns (e.g., cement columns 106*a-c*). The emission or discharge of the abrasive fluid at 606 may erode the milling surface to expose a further surface therebehind, as the abrasive fluid travels towards one or more casing-casing annuli (e.g., casing-casing annuli CCA-1 and CCA-2).

The method 600 may continue at 608 with rotating the jetting head via one or more rotational drivers (e.g., the rotational driver 124). The rotational drivers may be present within the running and control tool, the stroking tool, or a combination thereof. Through the rotational drivers, the jetting head may be rotated with respect to a remainder of the tool string above the rotational driver. The rotation of the jetting head may continue until a full circular travel is achieved to enable milling of an entire circumferential surface of the milling surface. A radially outward milling surface may be exposed behind the milling surface removed. The method 600 may continue at 610 with advancing (translating longitudinally) the jetting head within the wellbore via the stroking tool 116. The advancing of the jetting head at 610 may enable the erosion of further portions of the milling surface and exposing further portion of the radially outward milling surface. Once the jetting head has advanced at 610, the method 600 may return to 608 with the continued rotation of the jetting head. Performing the rotation at 608 and advancement at 610 of the jetting head in a cyclical manner may enable the milling of a hollow cylindrical portion (e.g., the casing window 204 and first cement window 206 of FIG. 2) of one of the concentric casing strings and/or cement columns to fully expose the surface radially behind. As such, the method 600 may repetitively cycle through rotation and advancement of the jetting head while constantly emitting abrasive fluid as at 606.

The method 600 may further include re-orienting the jetting head within the wellbore to aim the nozzles towards the next milling surface at 612. In some embodiments, the re-orientation of the jetting head may include pivoting the jetting head with respect to the running and control tool to a desired angle (e.g., the first angle 202, second angle 302, third angle 402, etc.). In further embodiments, however, the jetting head may be actuated to extend one or more telescoping members towards the milling surface to reduce the clearance therebetween. Re-orientation of the jetting head and nozzles at 612 may be performed entirely within the wellbore, such that trips out of hole are reduced, and the tool string may be controlled from a surface location. Following re-orientation of the jetting head, the method 600 may return to 604 with continued pumping of abrasive fluid and progressive rotation and advancement at 608 and 610. In some embodiments, a pumping pressure of the abrasive fluid may be tuned (increased or decreased) at 612 to adjust for the material of the next milling surface (e.g., steel or cement). The method 600 may continue until reaching the casing-casing annulus of interest, such that a repair operation may have access to a location of sustained casing pressure or a location where the sustained casing pressure may be remedied. According to some examples, the method 600 may include tripping the tool string out of the wellbore at 614 to enable the beginning of repair operations. As discussed above, the method 600 may provide access to a casing-casing annulus in which there is sustained casing pressure. As such, tripping the tool string out of the wellbore at 614 may enable the insertion of a packer, repair tool, or other repair component.

Embodiments disclosed herein include:

A. A tool string for progressive milling of concentric casing strings and cement columns in a wellbore, the tool string comprising an anchoring tool mateable to a downhole end of a tubing and operable engage the at least one of the concentric casing strings and cement columns to lock a position of the anchoring tool within the wellbore, a jetting head arranged at a downhole end of the tool string and including one or more nozzles for discharging an abrasive fluid from the jetting head towards one or more of the concentric casing strings and/or cement columns of the wellbore, and a running and control tool interposing the anchoring tool and jetting head, the running and control tool operable to adjust an orientation of the jetting head with respect to the anchoring tool within the wellbore.

B. A method of progressively milling one or more concentric casing strings and cement columns within a wellbore, the method comprising disposing a tool string within the wellbore and advancing the tool string to a milling location, pumping an abrasive fluid from a surface location to the tool string, discharging the abrasive fluid from one or more nozzles of a jetting head disposed at a downhole end of the tool string to erode a portion of a first one of the concentric casing strings and/or cement columns, and re-orienting the jetting head with respect to a running and control tool of the tool string to aim the nozzles towards a portion of a further one of the concentric casing strings and/or cement columns.

C. A wellbore system exhibiting a sustained casing pressure, the wellbore system comprising a plurality of concentric casing strings disposed within a wellbore, a plurality of cement columns each disposed radially outward of a respective one of the concentric casing strings, and a tool string disposed within a radially innermost one of the concentric casing strings. The tool string includes a jetting head including a plurality of nozzles through which an abrasive fluid may be discharged at a sufficient pressure to erode the concentric casing strings, the cement columns, or a combination thereof, and a running and control tool mated to the jetting head at an interface and including a pivoting mechanism operable to pivot the jetting head at one or more angles towards the concentric casing strings, the cement columns, or a combination thereof.

Each of embodiments A through C may have one or more of the following additional elements in any combination: Element 1: wherein the jetting head is pivotably coupled to the running and control tool at an interface defined therebetween. Element 2: wherein the running and control tool includes a pivoting mechanism at the interface to adjust an angle of the jetting head with respect to the running and control tool. Element 3: wherein the jetting head includes a plurality of telescoping members operable to extend the nozzles towards the concentric casing strings and/or the cement columns. Element 4: wherein the running and control tool includes a controller, the controller comprising a processor, a memory, and an access point for wired and/or wireless communication with the surface location. Element 5: wherein the memory stores computer-readable instructions that, when performed by the processor, adjusts the orientation of the jetting head within the wellbore. Element 6: further comprising a rotational driver operable to provide torque to effect rotation of the jetting head with respect to the anchoring tool within the wellbore. Element 7: further comprising a stroking tool interposing the anchoring tool and the running and control tool, is operable to longitudinally translate the running and control tool and the jetting head with respect to the anchoring tool. Element 8: wherein the stroking tool includes a stroking piston with a stroking piston head at a downhole end of the stroking tool and an extendible sleeve surrounding the stroking piston head translatable over the stroking piston, wherein the running and control tool is mounted to a downhole end of the extendible sleeve.

Element 9: wherein re-orienting the jetting head includes pivoting the jetting head via a pivoting mechanism of the running and control tool until forming a first angle between the jetting head and running and control tool. Element 10: wherein re-orienting the jetting head includes actuating one or more telescoping members of the jetting head via the running and control tool to reduce a clearance between the nozzles of the jetting head and the portion of the further one of the concentric casing strings and/or cement columns. Element 11: further comprising discharging the abrasive fluid from the nozzles of the jetting head towards the portion of the further one of the concentric casing strings and/or cement columns to erode a milling surface thereof. Element 12: further comprising: accessing a casing-casing annulus in which a sustained casing pressure has been identified; and tripping the tool string out of the wellbore to enable repair operations within the casing-casing annulus. Element 13: further comprising: extending one or more anchoring pads of an anchoring tool of the tool string to engage lock the anchoring tool in place via an interference fit; rotating the jetting head within the wellbore via one or more rotational drivers of the tool string; and advancing the jetting head longitudinally within the wellbore via a stroking tool of the tool string. Element 14: wherein the tool string further includes a stroking tool mated to an uphole end of the running and control tool and operable to translate the jetting head longitudinally uphole and/or downhole. Element 15: wherein the tool string further includes an anchoring tool including one or more anchoring pads operable to generate an interference fit with the radially innermost one of the concentric casing strings in the wellbore to limit motion of the tool string. Element 16: further comprising: a surface location including: a fluid reservoir including a volume of the abrasive fluid; a fluid pump in fluid communication with the fluid reservoir and operable to pressurize the abrasive fluid; and a fluid line in fluid communication with the fluid pump and the tool string to provide the abrasive fluid to the jetting head. Element 17: wherein the running and control tool further includes a controller, the controller comprising a processor, a memory, and an access point for wired and/or wireless communication with the surface location.

By way of non-limiting example, exemplary combinations applicable to A through C include: Element 1 with Element 2; Element 4 with Element 5; Element 7 with Element 8; Element 11 with Element 12; Element 14 with Element 15; and Element 16 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A tool string for milling concentric casing strings and cement columns in a wellbore, the tool string comprising:
- an anchoring tool operable to engage an inner wall of at least one of the concentric casing strings to lock a position of the anchoring tool within the wellbore;
- a jetting head arranged at a downhole end of the tool string and including one or more nozzles for discharging an abrasive fluid from the jetting head towards one or more of the concentric casing strings and/or the cement columns;
- a running and control tool interposing the anchoring tool and the jetting head and pivotably coupled to the jetting head, the running and control tool being operable to angularly pivot the jetting head away from a central axis of the running and control tool; and
- a stroking tool axially interposing the anchoring tool and the running and control tool and operable to longitudinally translate the running and control tool and the jetting head with respect to the anchoring tool, the stroking tool including:
  - a stroking piston;
  - a stroking piston head arranged at a downhole end of the stroking piston; and
  - an extendible sleeve surrounding the stroking piston head and translatable over the stroking piston, wherein the running and control tool is mounted to a downhole end of the extendible sleeve.

2. The tool string of claim 1, wherein the jetting head is pivotably coupled to the running and control tool at an interface defined therebetween.

3. The tool string of claim 2, wherein the running and control tool includes a pivoting mechanism operable to adjust an angle of the jetting head with respect to the running and control tool.

4. The tool string of claim 1, wherein the jetting head includes a plurality of telescoping members operable to extend the nozzles towards the concentric casing strings and/or the cement columns.

5. The tool string of claim 1, wherein the running and control tool includes a controller comprising a processor, a memory, and an access point for communication with a surface location.

6. The tool string of claim 5, wherein the memory stores computer-readable instructions that, when executed by the processor, adjust the orientation of the jetting head within the wellbore.

7. The tool string of claim 1, further comprising a rotational driver operable to provide torque to rotate the jetting head with respect to the anchoring tool within the wellbore.

8. A method of progressively milling one or more concentric casing strings and cement columns within a wellbore, the method comprising:
- conveying a tool string into the wellbore and advancing the tool string to a milling location;
- pumping an abrasive fluid from a surface location to the tool string;
- discharging the abrasive fluid from one or more nozzles of a jetting head disposed at a downhole end of the tool string;
- advancing the jetting head longitudinally within the wellbore via a stroking tool of the tool string, the stroking tool including:
  - a stroking piston,
  - a stroking piston head arranged at a downhole end of the stroking piston, and
  - an extendible sleeve surrounding the stroking piston head and translatable over the stroking piston;
- eroding a portion of a first one of the concentric casing strings and/or cement columns with the abrasive fluid; and
- re-orienting the jetting head with respect to a running and control tool of the tool string and thereby aiming the nozzles towards a portion of a further one of the concentric casing strings and/or cement columns,
- wherein the running and control tool is mounted to a downhole end of the extendible sleeve, and
- wherein re-orienting the jetting head includes angularly pivoting the jetting head away from a central axis of the running and control tool.

9. The method of claim 8, wherein re-orienting the jetting head includes pivoting the jetting head via a pivoting mechanism of the running and control tool until and thereby orienting the jetting head at a first angle relative to the running and control tool.

10. The method of claim 8, wherein re-orienting the jetting head includes actuating one or more telescoping members of the jetting head via the running and control tool and thereby reducing a clearance between the one or more nozzles and the portion of the further one of the concentric casing strings and/or cement columns.

11. The method of claim 8, further comprising discharging the abrasive fluid from the one or more nozzles and towards the portion of the further one of the concentric casing strings and/or cement columns and thereby eroding a milling surface thereof.

12. The method of claim 11, further comprising:
- accessing a casing-casing annulus in which a sustained casing pressure has been identified; and
- tripping the tool string out of the wellbore to enable repair operations within the casing-casing annulus.

13. The method of claim 8, wherein advancing the tool string to the milling location further comprises:
- extending one or more anchoring pads of an anchoring tool of the tool string and thereby securing the tool string within the wellbore; and
- rotating the jetting head within the wellbore via one or more rotational drivers of the tool string.

14. A wellbore system exhibiting a sustained casing pressure, the wellbore system comprising:
- a plurality of concentric casing strings disposed within a wellbore;
- a plurality of cement columns, each disposed radially outward of a respective one of the concentric casing strings; and
- a tool string disposed within a radially innermost one of the concentric casing strings, the tool string including:
  - a jetting head including a plurality of nozzles through which an abrasive fluid is dischargeable to erode the plurality of concentric casing strings, the plurality of cement columns, and a combination thereof;
  - a running and control tool operatively coupled to the jetting head and including a pivoting mechanism operable to angularly pivot the jetting head away from a central axis of the running and control tool and towards the concentric casing strings and the cement columns; and
  - a stroking tool operatively coupled to an uphole end of the running and control tool and operable to translate the jetting head longitudinally uphole and downhole, the stroking tool including:
    - a stroking piston, a stroking piston head arranged at a downhole end of the stroking piston, and an extendible sleeve surrounding the stroking piston head and translatable over the stroking piston, wherein the running and control tool is mounted to a downhole end of the extendible sleeve.

15. The wellbore system of claim 14, wherein the tool string further includes an anchoring tool operable to secure the tool string within the wellbore to limit motion of the tool string.

16. The wellbore system of claim 14, further comprising a surface location including:

a fluid reservoir including a volume of the abrasive fluid;

a fluid pump in fluid communication with the fluid reservoir and operable to pump the abrasive fluid; and a fluid line in fluid communication with the fluid pump and the tool string to provide the abrasive fluid to the tool string and the jetting head.

17. The wellbore system of claim 16, wherein the running and control tool further includes a controller comprising a processor, a memory, and an access point for communication with the surface location.

* * * * *